US005119128A

United States Patent [19]

Cherian

[11] Patent Number: 5,119,128

[45] Date of Patent: Jun. 2, 1992

[54] APPARATUS FOR GENERATING TIMING PULSES IN AN ELECTROPHOTOGRAPHIC PRINTING MACHINE

[75] Inventor: Abraham Cherian, Webster, N.Y.

[73] Assignee: Xerox Corporation, Stamford, Conn.

[21] Appl. No.: 688,799

[22] Filed: Apr. 22, 1991

[51] Int. Cl.[5] ..... G03G 15/00

[52] U.S. Cl. ..... 355/200; 250/231.14; 250/231.15

[58] Field of Search ..... 355/203, 200, 204, 205, 355/206, 207, 208, 209; 250/233, 231.15, 231.18, 231.14

[56] References Cited

U.S. PATENT DOCUMENTS

| | | | |
|---|---|---|---|
| 3,975,633 | 8/1976 | Larkin | 250/237 R |
| 4,270,860 | 6/1981 | Tsuda et al. | 355/200 |
| 4,470,692 | 9/1984 | Shimizu et al. | 355/209 |
| 4,667,098 | 5/1987 | Everett | 250/231.14 |
| 4,678,908 | 7/1987 | LaPlante | 250/231.14 |
| 4,703,176 | 10/1987 | Hahn et al. | 250/231.14 |
| 4,712,005 | 12/1987 | Savla | 250/231.14 |
| 4,731,638 | 3/1988 | Cherian | 355/200 |
| 4,860,051 | 8/1989 | Taniguchi et al. | 355/204 X |

*Primary Examiner*—A. T. Grimley
*Assistant Examiner*—Sandra L. Brasé
*Attorney, Agent, or Firm*—Paul J. Maginot

[57] ABSTRACT

An apparatus for generating timing pulses which includes a first flexible member having a plurality of spaced marks thereon, with the first flexible member being rotatably mounted. The apparatus further includes a second flexible member, positioned substantially adjacent the first flexible member, which has a plurality of spaced marks thereon, with the spaced marks of the second flexible member formed complementary to at least a portion of the spaced marks of the first flexible member, and with the second flexible member being mounted in a stationary manner. Moreover, the apparatus includes means for detecting when the spaced marks of the second flexible member are positioned substantially complementary to the portion of the spaced marks of the first flexible member and generating a timing pulse output in response thereto.

12 Claims, 6 Drawing Sheets

APPARATUS FOR GENERATING TIMING PULSES IN AN ELECTROPHOTOGRAPHIC PRINTING MACHINE

This invention relates generally to an electrophotographic printing machine, and more particularly concerns an apparatus for generating timing pulses therein.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a toner material into contact therewith. This forms a toner image on the photoconductive member which is subsequently transferred to a copy sheet. Finally, the toner image is heated to permanently fuse it to the copy sheet in image configuration. The toner material may be a liquid or a powder.

In an electrophotographic printing machine, a plurality of processing stations are positioned about the photoconductive member. Furthermore, other processing stations are located in the path of the copy sheet. These processing stations perform all of the operations necessary to insure that a completed copy of an original document is generated. Each processing station is energized at a selected time during the operating cycle. This is achieved by a timing pulse generator associated with the photoconductive member. Generally, the timing pulse generator includes a disk having a plurality of spaced apart marks thereon arranged to rotate with the photoconductive drum. Each mark is an event signal for timing the operations in the printing machine. Generally, the disk has markings thereon or slits formed therein. A light source and a photodetector are respectively disposed on the opposed sides of the disk to sense the passage of the marks or slits. In this way, a pulse is generated for each increment between adjacent marks or slits on the disk. These pulses are transmitted to the control system which actuates the appropriate processing station at the requisite time to insure the formation of a copy of the original document on the sheet of support material.

One problem with the above timing pulse generator arrangement is its relatively low signal-to-noise ratio due to its inadequacy to block from the photodetector substantially all of the light emitted from the light source when such blockage is desired. Thus, a pulse may be mistakenly generated (or mistakenly not generated) at a given time which may result in untimely activation of the various processing stations of the electrophotographic printing machine.

The following disclosures may be relevant to various aspects of the present invention:

U.S. Pat. No. 3,975,633; Patentee: Larkin; Issued: Aug. 7, 1976.

U.S. Pat. No. 4,667,098; Patentee: Everett; Issued: May 19, 1987.

U.S. Pat. No. 4,678,908; Patentee: LaPlante; Issued: Jul. 7, 1987.

U.S. Pat. No. 4,703,176; Patentee: Hahn et al.; Issued: Oct. 27, 1987.

U.S. Pat. No. 4,712,005; Patentee: Savla; Issued: Dec. 8, 1987.

U.S. Pat. No. 4,731,638; Patentee: Cherian; Issued: Mar. 15, 1988.

Larkin discloses an optical encoder having encoded tracks on a strip of film. Each track has a series of spaced alternating transparent and opaque rectangular regions. The encoder further includes a light source which illuminates the the alternating transparent regions to produce a pattern of light beams that can be read by an optical detector and decoded to determine a position measurement.

Everett describes an optical shaft encoder which includes a piece of coding material made from a flexible photographic film base material. The coding material has a pair of circumferential optical coding tracks disposed on its surface. The two coding tracks contain optical coding elements in the form of alternating light transmissive and obstructive areas.

LaPlante discloses an optical encoder for providing positional information. The encoder uses a detector to measure the degree of registration between an index sequence on a code disc and an identical sequence on a mask.

Hahn et al. describes an optical encoder having a mask which includes a plurality of spaced apart translucent regions which are separated by light opaque regions. The encoder further includes a light source and a photodetector array positioned in relation to the mask so that movement of the mask causes intermittent coupling and decoupling of the light source and photodetector.

Savla discloses an optical shaft encoder for converting rotary motion to an electrical signal. The encoder includes a shaft that is rotatably mounted in a base and has a code disk attached thereto. The encoder further includes a light source and photodetector which are respectively disposed on opposite sides of the code disk.

Cherian describes a timing pulse generator for an electrophotographic printing machine. The timing pulse generator includes a rotatable flexible member having spaced marks formed thereon. As the flexible member rotates, the spaced marks are detected to generate a timing pulse output in response thereto.

In accordance with one aspect of the present invention, there is provided an apparatus for generating timing pulses. The apparatus comprises a first flexible member having a plurality of spaced marks thereon, with the first flexible member being rotatably mounted. The apparatus further comprises a second flexible member, positioned substantially adjacent the first flexible member, which has a plurality of spaced marks thereon, with the spaced marks of the second flexible member formed complementary to at least a portion of the spaced marks of the first flexible member, and with the second flexible member being mounted so as to be stationary. Moreover, the apparatus comprises means for detecting when the spaced marks of the second flexible member are positioned substantially complementary to the portion of the spaced marks of the first flexible member and generating a timing pulse output in response thereto.

Pursuant to another aspect of the present invention, there is provided an electrophotographic printing machine of the type having a moving photoconductive member. The printing machine comprises a plurality of processing stations arranged to reproduce copies of an original document. The printing machine further comprises a first flexible member having a plurality of spaced marks thereon and means for rotatably mounting the first flexible member on the photoconductive member to move in unison therewith. The printing machine also comprises a second flexible member, positioned substantially adjacent the first flexible member, which has a plurality of spaced marks thereon, with the spaced marks of the second flexible member formed complementary to at least a portion of the spaced marks of the first flexible member, and with the second flexible member being mounted so as to be stationary. Further, the apparatus comprises means for detecting when the spaced marks of the second flexible member are positioned substantially complementary to the portion of the spaced marks of the first flexible member and generating a timing pulse output in response thereto.

Other features of the present invention will become apparent as the following description proceeds and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
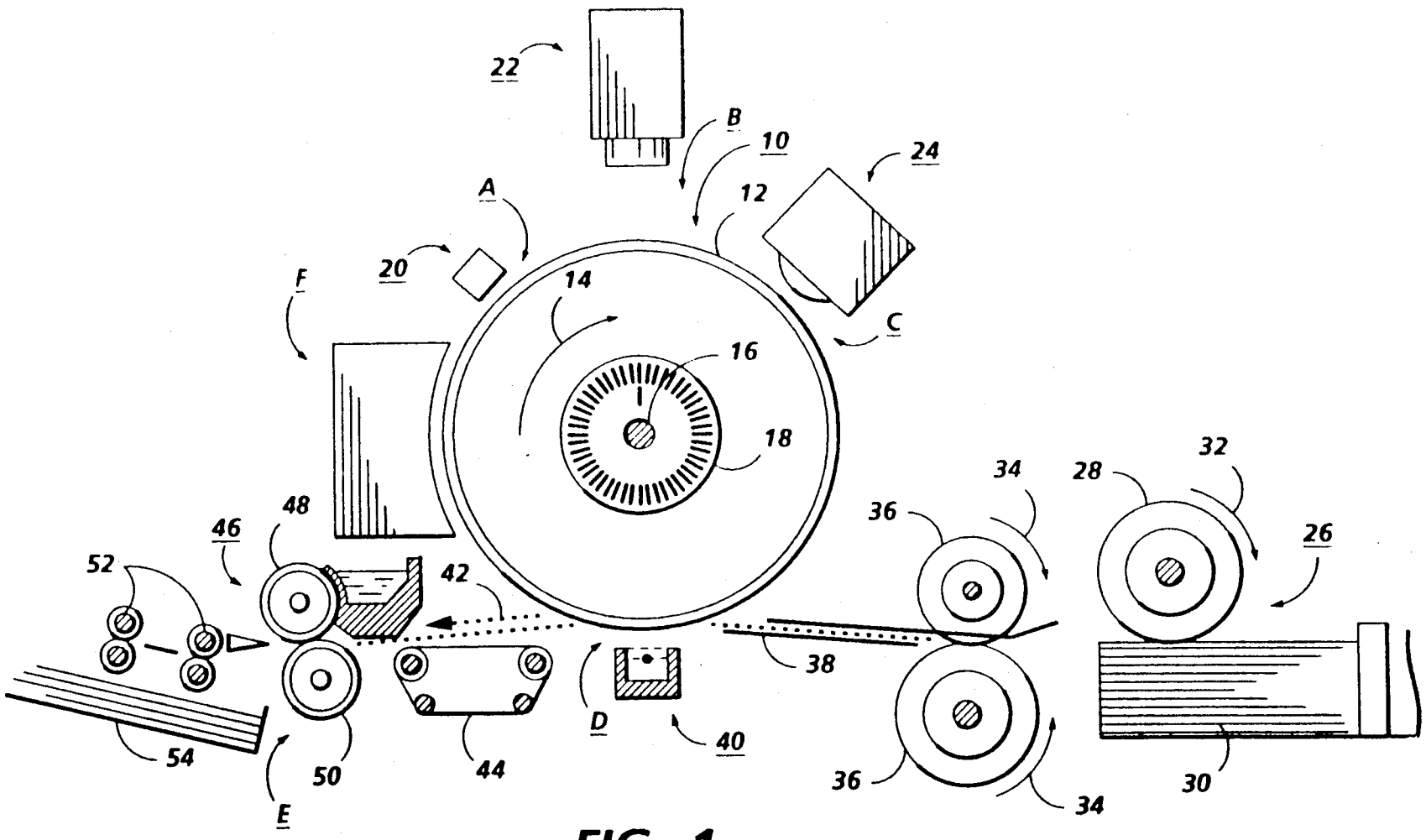
FIG. 1 is a schematic elevational view showing an electrophotographic printing machine incorporating various features of the present invention therein.

Inasmuch as the art of electrophotographic printing is well known, the various processing stations employed in the electrophotographic printing machine of FIG. 1 will be shown hereinafter schematically and their operation described briefly with reference thereto. As shown in FIG. 1, the illustrative electrophotographic printing machine employs a drum 10 having a photoconductive surface 12. By way of example, photoconductive surface 12 is made from a selenium alloy adhering to an electrically grounded conductive substrate, made from aluminum. Drum 10 is mounted on a rotatable shaft 16 which extends outwardly therefrom. A disk 18 is mounted on shaft 16 and therefore is rotatable about the axis of shaft 16. A stationary disk 19 (not shown in FIG. 1) is positioned substantially adjacent rotatable disk 18 on the side thereof which faces drum 10. The drum moves in the direction of arrow 14 to advance photoconductive surface 12 sequentially through a variety of processing stations disposed about the path of movement thereof.

Initially, a portion of photoconductive surface 12 passes through charging station A. At charging station A, a corona generating device, indicated generally by the reference numeral 20 charges photoconductive surface 12 to a relatively high, substantially uniform potential.

Next, the charged portion of photoconductive surface 12 is advanced through exposure station B. Exposure station B includes an exposure system indicated generally by the reference numeral 22. Exposure system 22 includes a light source which illuminates an original document positioned face down upon a transparent platen. Light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the informational areas contained within the original document. One skilled in the art will appreciate that in lieu of the foregoing optical system, a modulated beam of energy, i.e. a laser beam, or other suitable device, such as light emitting diodes may be used to irradiate the charged portion of the photoconductive surface so as to record selected information thereon. Information from a computer may be employed to modulate the laser beam or selectively energize the light emitting diodes.

After the electrostatic latent image is recorded on photoconductive surface 12, drum 10 advances the latent image to development station C. At development station C, a magnetic brush development system, indicated generally by the reference numeral 24, advances a developer material comprising carrier granules and toner particles into contact with the electrostatic latent image. The latent image attracts the toner particles from the carrier granules of the developer material to form a toner powder image on photoconductive surface 12 of drum 10.

Drum 10 then advances the toner powder image adhering to photoconductive surface 12 to transfer station D. At transfer station D, a sheet of support material is moved into contact with the powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 28 rotates in the direction of arrow 32 to advance the uppermost sheet into the nip defined by forwarding rollers 36. Forwarding rollers 36 rotate in the direction of arrows 34 to advance the sheet into chute 38. Chute 38 directs the advancing sheet of support material into contact with photoconductive surface 12 of drum 10 in a timed sequence so that the toner powder image developed thereon contacts the advancing sheet at transfer station D. Preferably, transfer station D includes a corona generating device 40 for spraying ions onto the backside of the sheet. This attracts the toner powder image from photoconductive surface 12 to the sheet. After transfer, the sheet continues to move in the direction of arrow 42 onto conveyor 44 which advances the sheet to fusing station E.

Fusing station E includes a fuser assembly, indicated generally by the reference numeral 46, which permanently fuses the transferred toner powder image to the sheet. Fuser assembly 46 includes a heated fuser roller 48 and a back-up roller 50. The sheet passes between fuser roller 48 and back-up roller 50 with the toner powder image contacting fuser roller 48. In this manner, the toner powder image is permanently fused to the sheet. After fusing, forwarding rollers 52 advance the sheet to catch tray 54 for removal from the printing machine by the operator.

Invariably, after the sheet of support material is separated from photoconductive surface 12 of drum 10, some residual particles remain adhered thereto. These residual particles are removed from photoconductive surface 12 at cleaning station F. Preferably, cleaning station F includes a rotatably mounted brush in contact with photoconductive surface 12. The particles are cleaned from photoconductive surface 12 by the rotation of the brush in contact therewith. Subsequent to cleaning, a discharge lamp floods photoconductive surface 12 with light to dissipate any residual electrostatic charge remaining thereon prior to the charging thereof for the next successive imaging cycle.

Figure 2:
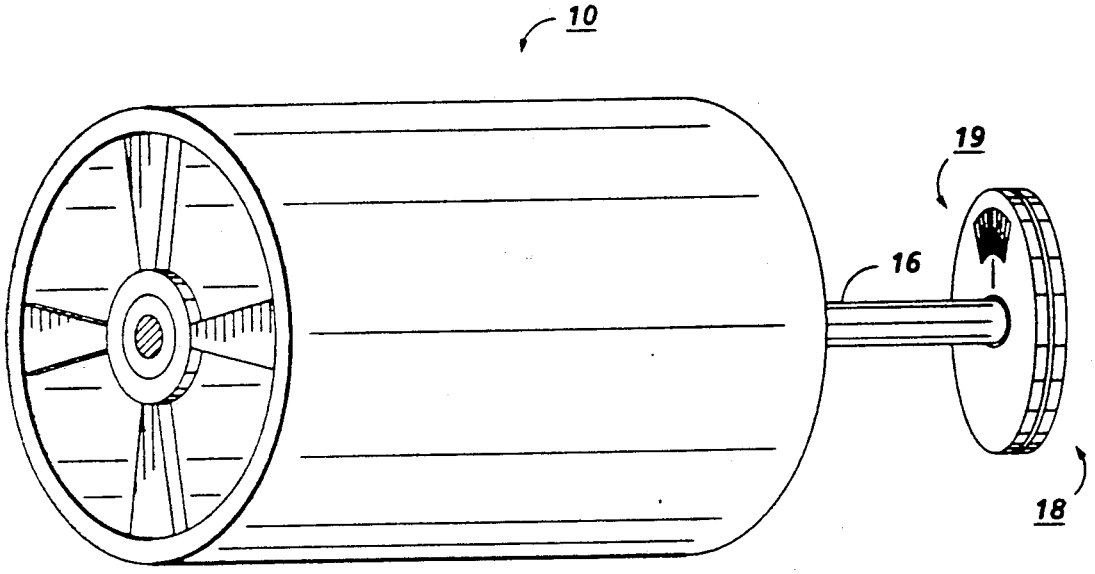
FIG. 2 is a schematic perspective view showing the location of the disks relative to the drum and shaft of the electrophotographic printing machine of FIG. 1.

Referring now to FIG. 2, there is shown an arrangement of rotatable disk 18 and stationary disk 19 to generate timing signals for synchronizing the occurrence of the various machine processes and events with the rotation of drum 10. More specifically, rotatable disk 18 is secured to shaft 16 which extends from drum 10. Disk 19 is mounted in a stationary manner substantially adjacent rotatable disk 18 on the side of disk 18 closest to drum 10. Rotatable disk 19 possesses a hole 33 (see also FIG. 4) near its center to allow shaft 16 to extend therethrough.

Figure 3:
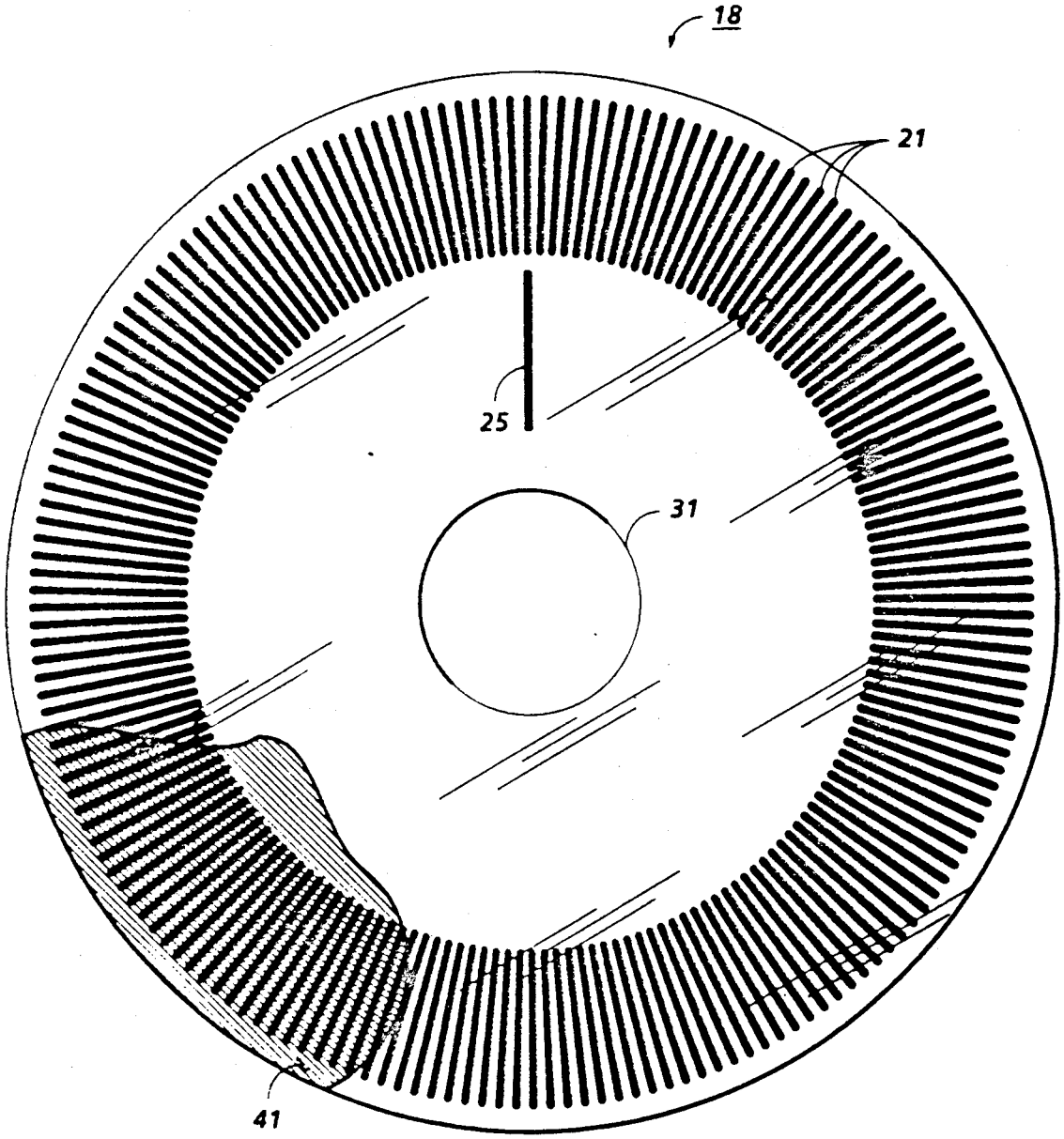
FIG. 3 is an elevational view showing the rotating disk of FIG. 2.

FIG. 3 is an elevational view showing rotatable disk 18 of the present invention. Disk 18 is made from a flexible, plastic photographic film. By way of example, disk 18 can be made from Mylar, a trademark of E. I. du Pont de Nemours & Co., Inc. A transparent protective material 41 (partially shown in FIG. 3) is coated on the side of disk 18 which faces disk 19 (see also FIGS. 6A and 6B). Protective material 41 is preferably a diamond film such as a synthetic diamond film available from Energy Conversion Devices, Inc. of Troy, Mich. Disk 18 has a plurality of marks 21 formed thereon about its circumference. Marks 21 of disk 18 are substantially opaque while the spaces therebetween are substantially transparent. The entire remaining portion of disk 18 is also transparent except for a substantially opaque reference mark 25. Marks 21 and 25 are precisely located with respect to a locating hole 31. In manufacturing disk 18, a blank disk has locating hole 31 formed therein. This hole is then used to mount the blank disk in a fixture. At this time, marks 21 and 25 are photographically formed on the blank disk. After the marks have been formed, the same hole 31 is used to mount disk 18 onto shaft 16 which extends from drum 10 (see also FIGS. 1 and 2). This insures the precise alignment of marks 21 and 25 with respect to drum 10. As a result, each mark 21 has a predetermined angular orientation with respect to reference mark 25, the reference mark being oriented with respect to a predetermined position of drum 10.

Figure 4:
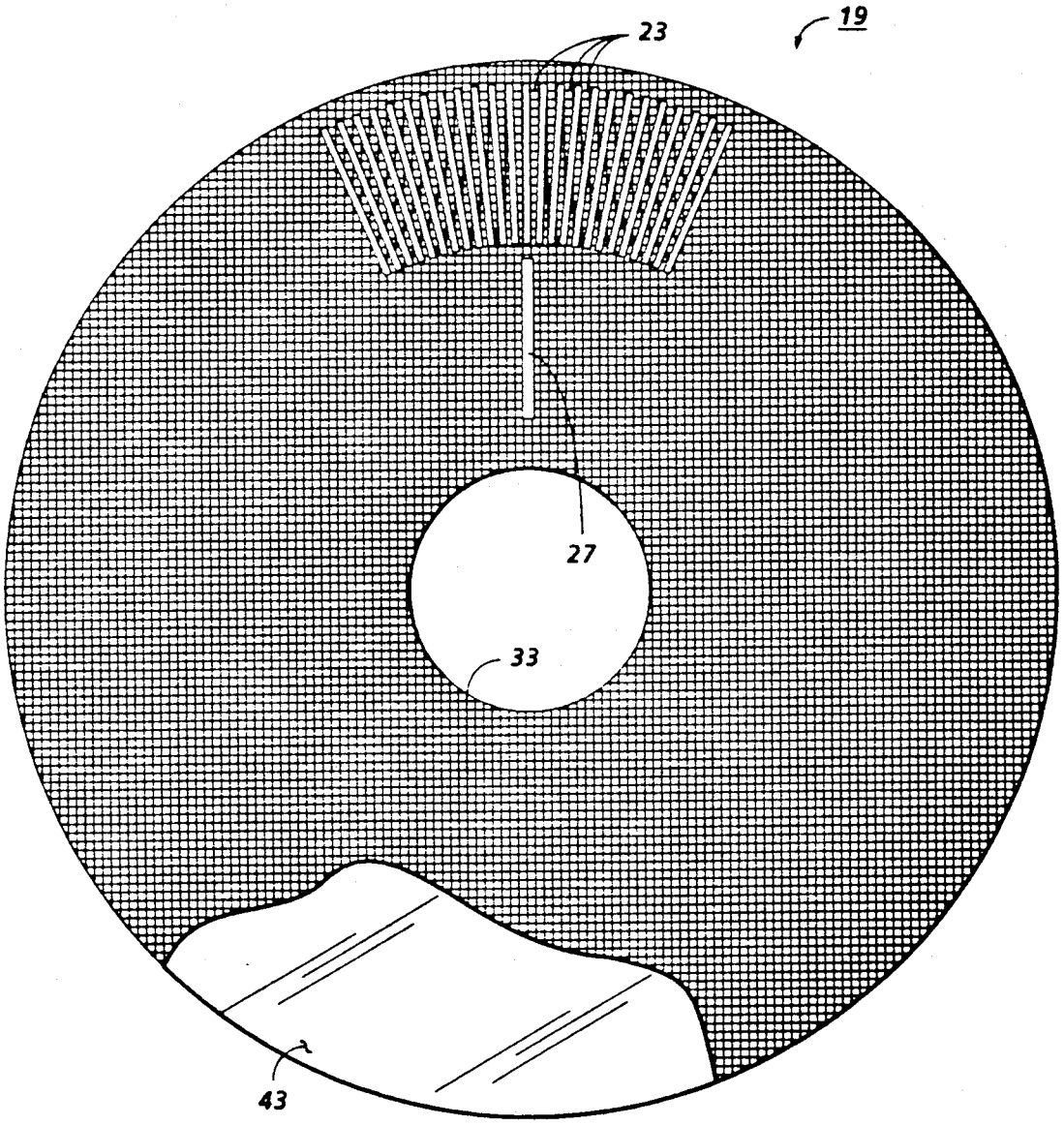
FIG. 4 is an elevational view showing the stationary disk of FIG. 2.

FIG. 4 is an elevational view of stationary disk 19 of the present invention. Disk 19 is made from a flexible, plastic photographic film. By way of example, disk 19 can be made from Mylar, a trademark of E. I. du Pont de Nemours & Co., Inc. A transparent protective material 43 (partially shown in FIG. 4) is coated on the side of disk 19 which faces disk 18 (see also FIGS. 6A and 6B). Protective material 43 is preferably a diamond film such as a synthetic diamond film available from Energy Conversion Devices, Inc. of Troy, Mich. A plurality of marks 23 are formed on disk 19. Marks 23 of disk 19 are formed complementary to a portion of marks 21 of disk 18. Marks 23 of disk 19 are substantially opaque while the spaces therebetween are substantially transparent. The entire remaining portion of disk 19 is substantially opaque except for a substantially transparent reference mark 27. Marks 23 and 27 are precisely located with respect to a locating hole 33. In manufacturing disk 19, a blank disk has locating hole 33 formed therein. This hole is then used to mount the blank disk in a fixture. At this time, marks 23 and 27 are photographically formed on the blank disk. After the marks have been formed, the same hole 33 is used to mount disk 18 in a stationary position concentric with shaft 16 extending from drum 10. This insures the precise alignment of marks 23 and 27 with respect to drum 10 and marks 21 and 25.

Figure 5A:
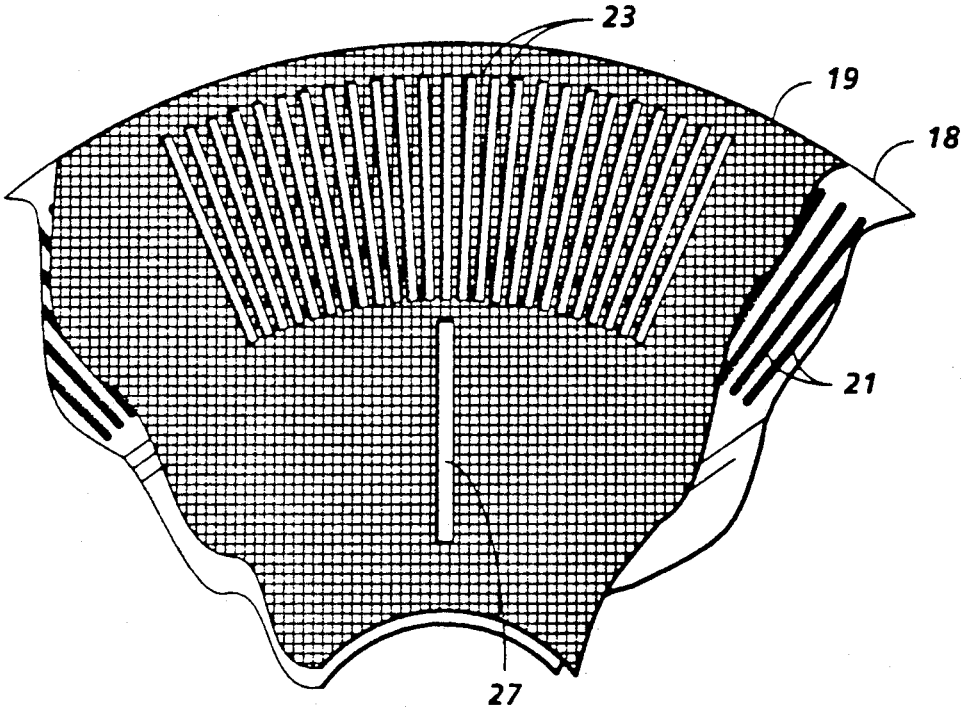
FIG. 5A is a fragmentary elevational view showing the stationary disk positioned adjacent the rotating disk where the marks of the disks are aligned to allow passage of a light beam.
Figure 5B:
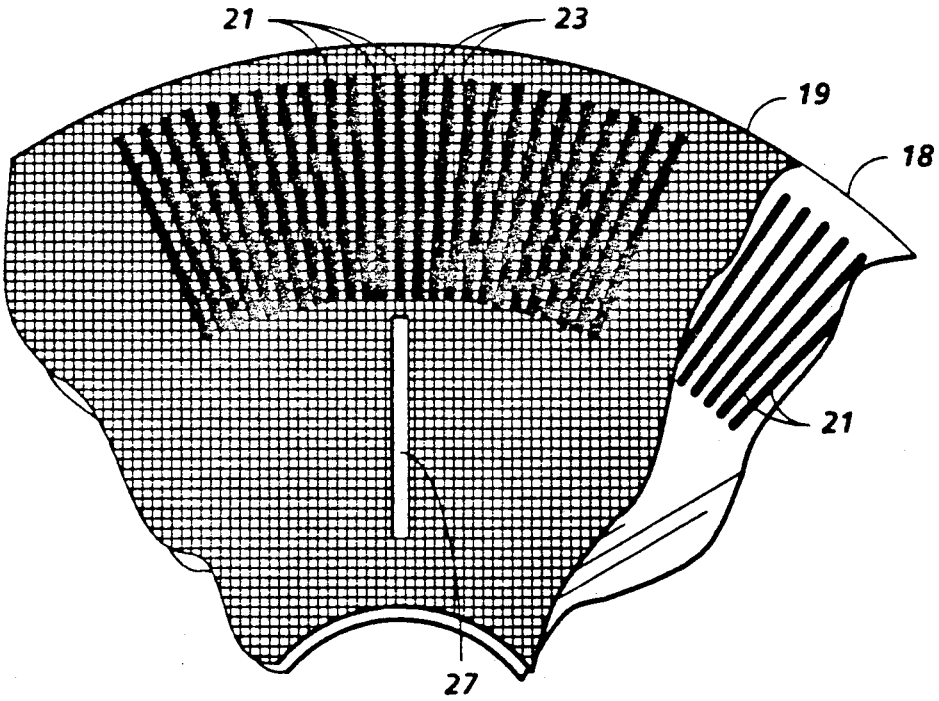
FIG. 5B is a fragmentary elevational view showing the stationary disk positioned adjacent the rotating disk where the marks of the disks are positioned substantially complementary to each other to effect blockage of a light beam.

Turning now to FIG. 5A, there is shown a fragmentary elevational view of disks 18 and 19 where the rotational position of disk 18 is such that a portion of its marks 21 are substantially aligned with marks 23 of disk 19. At this position, transparent areas of disk 18 are aligned with transparent areas of disk 19 thus enabling a beam of light to be transmitted through the two disks. However, as disk 18 rotates relative to disk 19, a portion of marks 21 of disk 18 become positioned substantially complementary to marks 23 of stationary disk 19, as shown in FIG. 5B. When marks 21 and 23 are positioned as above, the complementary positioning of the opaque marks effect blockage of a beam of light.

Figure 6A:
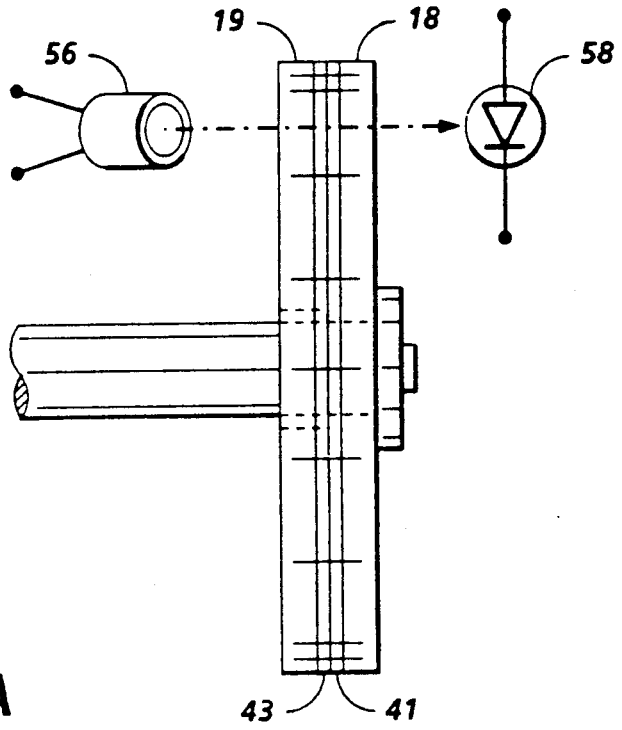
FIG. 6A is a schematic side elevational view illustrating a signal generating arrangement employed with the disks of FIG. 2 where the disks are positioned relative to each other as shown in FIG. 5A.
Figure 6B:
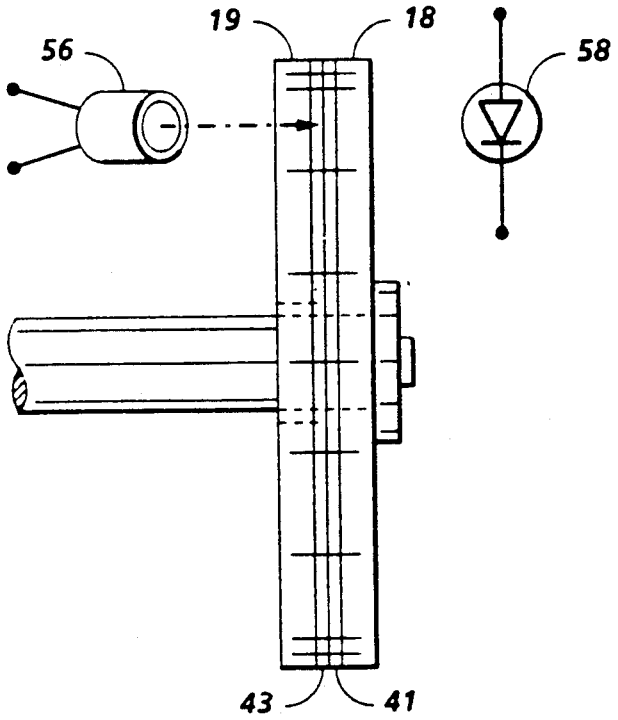
FIG. 6B is a schematic side elevational view illustrating the signal generating arrangement and disks of FIG. 6A where the disks are positioned relative to each other as shown in FIG. 5B.

Turning now to FIGS. 6A and 6B, a light source 56 such as a light emitting diode is positioned on one side of disks 18 and 19 with photodetector 58 being positioned on the opposite side. Disks 18 and 19 are positioned substantially adjacent each other such that they are in frictional contact during at least a portion of one revolution of disk 18. Protective coatings 41 and 43 of respective disks 18 and 19 function to reduce the frictional resistance therebetween during rotation of disk 18. Light source 56 and the photodetector 58 are located near a portion of disks 18 and 19 respectively containing marks 21 and marks 23. As a result, a beam of light emitted from light source 56 is intermittently transmitted through disks 18 and 19 as disk 18 rotates about the axis of shaft 16. The beam of light is transmitted through disks 18 and 19 at all positions of rotation of disk 18 except when marks 23 of stationary disk 19 are positioned substantially complementary to a portion of marks 21 of rotating disk 18. When the light beam is transmitted through disks 18 and 19, as shown in FIG. 6A, such light beam is detected by photodetector 58. On the other hand, when the opaque marks of disk 19 are positioned complementary to a portion of the opaque marks of disk 18 so as to substantially block the path of the light beam, as illustrated in FIG. 6B, photodetector 58 senses the blockage of light. In response to the light blockage, or failure to detect the light beam, photodetector 58 emits an electrical pulse. In this way, a series of electrical pulses are generated as drum 10 rotates (see FIG. 1). These pulses act as an event or timing pulse for energizing and de-energizing the various processing stations in the electrophotographic printing machine. The occurence and time of these pulses are related to the angular position of drum 10 with respect to reference marks 25 and 27. These pulses comprise the event clock signal. The above timing pulse generator arrangement provides for a relatively high signal-to-noise ratio due to its ability of effectively block from photodetector 58 substantially all of the light emitted from light source 56. A similar light source and photodetector (not shown) are also provided in position on opposite sides of adjacent disks 18 and 19 near reference marks 25 and 27 for generating a single signal termed a pitch signal for each complete revolution of drum 10 (see FIG. 1). The number of marks on disk 18 defines the number of events that occur with respect to predetermined rotational positions of drum 10. This number can vary in accordance with the specifics of the printing machine and its requirements. In an exemplary electrophotographic printing machine, there can be as many as 500 marks formed photographically on disk 18 so as to generate 500 pulses or events for each revolution thereof.

In recapitulation, it is clear that each of the adjacent disks of the present invention are formed from a thin plastic film. Each disk has a plurality of marks formed photographically thereon. A sensor assembly detects when a portion of the spaced marks of the rotatable disk are positioned substantially complementary to the marks of the stationary disk and generates a timing pulse output in response thereto.

It is, therefore, evident that there has been provided in accordance with the present invention, an apparatus for generating timing pulses in an electrophotographic printing machine that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for generating timing pulses, comprising:

a first flexible member having a plurality of spaced marks thereon, with said first flexible member being rotatably mounted;

a second flexible member, substantially juxtaposed to said first flexible member, having a plurality of spaced marks thereon, with the spaced marks of said second flexible member formed complementary to at least a portion of the spaced marks of said first flexible member, and with said second flexible member being mounted so as to be stationary; and means for detecting when the spaced marks of said second flexible member are positioned substantially complementary to the portion of the spaced marks of said first flexible member and generating a timing pulse output in response thereto.

2. The apparatus of claim 1, wherein the spaced marks of said first flexible member and the spaced marks of said second flexible member are substantially opaque.

3. The apparatus of claim 1, wherein said detecting means comprises:

a light source positioned to direct a beam of light through said first and second flexible members; and a photodetector positioned to receive the beam of light and to produce timing pulses in response to the blockage of the light beam by said first and second flexible members.

4. An apparatus for generating timing pulses, comprising:

a first flexible member having a plurality of spaced marks thereon, with said first flexible member being rotatably mounted;

a second flexible member, positioned substantially adjacent said first flexible member, having a plurality of spaced marks thereon, with the spaced marks of said second flexible member formed complementary to at least a portion of the spaced marks of said first flexible member, and with said second flexible member being mounted so as to be stationary, and further wherein said first flexible member is in frictional contact with said second flexible member during at least a portion of one revolution of said first flexible member; and means for detecting when the spaced marks of said second flexible member are positioned substantially complementary to the portion of the spaced marks of said first flexible member and generating a timing pulse output in response thereto.

5. The apparatus of claim 4, wherein said first flexible member and said second flexible member each possess a layer of protective material thereon so that frictional resistance therebetween is reduced during rotation of said first flexible member.

6. The apparatus of claim 5, wherein the protective coating comprises a diamond film.

7. An electrophotographic printing machine of the type having a moving photoconductive member, comprising:

a plurality of processing stations arranged to reproduce copies of an original document;

a first flexible member having a plurality of spaced marks thereon;

means for rotatably mounting said first flexible member on the photoconductive member to move in unison therewith;

a second flexible member, substantially juxtaposed to said first flexible member, having a plurality of spaced marks thereon, with the spaced marks of said second flexible member formed complementary to at least a portion of the spaced marks of said first flexible member, and with said second flexible member being mounted so as to be stationary; and means for detecting when the spaced marks of said second flexible member are positioned substantially complementary to the portion of the spaced marks of said first flexible member and generating a timing pulse output in response thereto.

8. The printing machine of claim 7, wherein the spaced marks of said first flexible member and the spaced marks of said second flexible member are substantially opaque.

9. The printing machine of claim 7, wherein said detecting means comprises:

a light source positioned to direct a beam of light through said first and second flexible members; and a photodetector positioned to receive the beam of light and to produce timing pulses in response to the blockage of the light beam by said first and second flexible members.

10. An electrophotographic printing machine of the type having a moving photoconductive member, comprising:

a plurality of processing stations arranged to reproduce copies of an original document;

a first flexible member having a plurality of spaced marks thereon:

means for rotatably mounting said first flexible member on the photoconductive member to move in unison therewith:

a second flexible member, positioned substantially adjacent said first flexible member, having a plurality of spaced marks thereon, with the spaced marks of said second flexible member formed complementary to at least a portion of the spaced marks of said first flexible member, and with said second flexible member being mounted so as to be stationary, and further wherein said first flexible member is in frictional contact with said second flexible member during at least a portion of one revolution of said first flexible member: and means for detecting when the spaced marks of said second flexible member are positioned substantially complementary to the portion of the spaced marks of said first flexible member and generating a timing pulse output in response thereto.

11. The printing machine of claim 10, wherein said first flexible member and said second flexible member each possess a layer of protective material thereon so that frictional resistance therebetween is reduced during rotation of said first flexible member.

12. The printing machine of claim 11, wherein the protective material comprises a diamond film.

* * * * *